US005372074A

United States Patent [19]

Kilpatrick et al.

[11] Patent Number: 5,372,074

[45] Date of Patent: Dec. 13, 1994

[54] PAPERBOARD PALLET

[75] Inventors: Ted D. Kilpatrick, Ponte Vedra Beach, Fla.; Arthur M. Wagner, Geneva, Ill.

[73] Assignee: Gate Pallet Systems, Inc., Crown Point, Ind.

[21] Appl. No.: 906,356

[22] Filed: Jun. 30, 1992

Related U.S. Application Data

[63] Continuation-in-part of Ser. No. 883,137, May 14, 1992, abandoned.

[51] Int. Cl.[5] ..... B65D 19/00

[52] U.S. Cl. ..... 108/51.3

[58] Field of Search ..... 108/51.3, 51.1, 56.3

[56] References Cited

U.S. PATENT DOCUMENTS

| | | | |
|---|---|---|---|
| 2,446,914 | 8/1948 | Fallert et al. | 108/51.3 |
| 2,728,545 | 12/1955 | Hermitage | 108/51.3 |
| 2,928,638 | 3/1960 | Parker | 108/51.3 |
| 2,955,791 | 10/1960 | George . | |
| 3,167,038 | 1/1965 | Brown . | |
| 3,302,593 | 2/1967 | Roberts | 108/51.3 |
| 3,464,371 | 9/1969 | Gifford | 108/51.3 |
| 3,480,196 | 11/1969 | De Simas | 108/51.3 X |
| 3,587,479 | 6/1971 | Geschwender | 108/51.3 |
| 3,659,534 | 5/1972 | Childs | 108/51.3 |
| 3,683,822 | 8/1972 | Roberts et al. . | |
| 3,934,805 | 1/1976 | Elaschuk . | |
| 3,952,672 | 4/1976 | Gordon et al. . | |
| 4,399,972 | 8/1983 | McCulloch . | |
| 4,563,377 | 1/1986 | Melli . | |
| 4,792,325 | 12/1988 | Schmidtke | 108/51.3 X |
| 4,867,074 | 9/1989 | Quasnick | 108/51.3 |
| 4,875,419 | 10/1989 | Helton et al. . | |
| 5,001,991 | 3/1991 | Smith | 108/51.3 |

FOREIGN PATENT DOCUMENTS

| | | | |
|---|---|---|---|
| 512367 | 10/1971 | Switzerland . | |
| 9212061 | 12/1990 | WIPO | 108/51.3 |

*Primary Examiner*—Jose V. Chen

*Attorney, Agent, or Firm*—Dressler, Goldsmith, Shore & Milnamow

[57] ABSTRACT

A paperboard pallet having a trapezoidal profile is disclosed, which comprises two outer stringers, an additional stringer therebetween, an upper sheet, and a lower sheet. Each stringer has a trapezoidal profile. The upper sheet is secured adhesively to a broad, upper end of each stringer. The lower sheet has two outer flaps, each being folded upwardly and being secured adhesively to an outer wall of a respective one of the outer stringers. The upper sheet may have two outer flaps, each being folded downwardly and being secured adhesively to such an outer wall. Several alternative arrangements are disclosed, which include one wherein a lower base of a paperboard tray defines the upper sheet, another wherein a lower base of a paperboard carton defines the upper sheet, and others wherein blocks cut from such stringers replace the stringers.

17 Claims, 4 Drawing Sheets

PAPERBOARD PALLET

This application is a continuation-in-part of U.S. patent application Ser. No. 07/883,137 filed May 14, 1992, now abandoned by the Ted D. Kilpatrick and Arthur M. Wagner for PAPERBOARD PALLET.

TECHNICAL FIELD OF THE INVENTION

This invention pertains to a paperboard pallet having a trapezoidal profile and comprising two outer stringers having tapered profiles or two rows of outer blocks having tapered profiles and at least one sheet having two outer flaps, each being folded and being secured in surface-to-surface contact to an outer wall of a respective one of the outer stringers or to the outer walls of at least two outer blocks. The flaps may be adhesively secured.

BACKGROUND OF THE INVENTION

As exemplified in Quasnick U.S. Pat. No. 4,867,074 and Smith U.S. Pat. No. 5,001,991, paperboard pallets can exhibit substantial resistance to crushing and substantial beam strength in orthogonal directions. The pallets exemplified therein have longitudinal stringers with trapezoidal profiles, which provide such pallets with substantial resistance to crushing and with substantial beam strength in a longitudinal direction. The pallets exemplified therein have transverse decking members with trapezoidal profiles, which provide such pallets with substantial beam strength in a transverse direction. The Smith patent noted above discloses that tubular reinforcing pieces may be advantageously used to reinforce the stringers of such a pallet.

As exemplified in Hermitage U.S. Pat. No. 2,728,545, it is known for a paperboard pallet to have longitudinal stringers with trapezoidal profiles and to have flat upper and lower platforms secured to such stringers by wire bindings or adhesively. Such upper and lower platforms are disclosed therein as extending beyond the lateral walls of the outer stringers.

As exemplified in Fallert et al. U.S. Pat. No. 2,446,914, it is known for a paperboard pallet with a rectangular profile to have longitudinal stringers with rectangular profiles, upper sheets with end flaps folded downwardly and secured adhesively thereto, and lower sheets with end flaps folded upwardly and secured adhesively thereto. Gifford U.S. Pat. No. 3,464,371 discloses paperboard pallets of related interest, also with rectangular profiles.

So-called "nine-block" pallets are known. Such a pallet comprises nine blocks in a rectangular array, an upper sheet secured adhesively to an upper end of each block, and a lower sheet secured adhesively to a lower end of each block. In one form known heretofore each block is made from corrugated paperboard, which is folded into a rectangular profile, secured adhesively to retain the rectangular profile, and disposed with its corrugations extending vertically.

SUMMARY OF THE INVENTION

This invention provides a paperboard pallet of a novel construction. The paperboard pallet has a trapezoidal profile and comprises two outer stringers, each having a tapered profile, preferably a trapezoidal profile. The tapered profile of each outer stringer defines a broad, upper end, a lower end, and two lateral walls tapering toward each other from the broad end to the opposite end. The lateral walls include an outer wall defining an acute angle relative to the upper end. A sheet is secured in surface-to-surface contact to the broad ends of the outer stringers and has two outer flaps, each being folded and being secured surface-to-surface contact to the outer wall of a respective one of the outer stringers.

According to certain embodiments contemplated by this invention, an upper sheet is secured in surface-to-surface contact to the broad, upper end of each outer stringer. Moreover, a lower sheet has two outer flaps, each being folded upwardly and being secured in surface-to-surface contact to the outer wall of a respective one of the outer stringers. Preferably, the upper sheet has a planar portion and two outer flaps, each being folded downwardly at an acute angle relative to the planar portion and being secured in surface-to-surface contact (e.g. adhesively) to the outer wall of a respective one of the outer stringers. If each outer stringer has a trapezoidal profile defining a narrow, lower end, the lower sheet may be adhesively secured to such end.

This invention contemplates that a paperboard pallet, as described in the preceding paragraph, may be advantageously combined with a paperboard tray or paperboard carton having a base wall defining the upper sheet of the pallet for purposes of this invention.

According to other embodiments contemplated by this invention, an upper sheet has a planar portion and two outer flaps, each being folded downwardly from the broad, upper end of the respective one of the outer stringers to its lower end and being secured adhesively to the outer wall of a respective one of the outer stringers. Each of the outer flaps is folded downwardly at an acute angle relative to the planar portion of the upper sheet.

In any of the embodiments described in the preceding paragraph, a lower sheet having a planar portion and two outer flaps may be also included. If each outer flap of the upper sheet extends downwardly from the broad, upper end of the respective one of the outer stringers to its lower end, each outer flap of the lower sheet may be then folded upwardly and secured adhesively to a respective one of the outer flaps of the upper sheet. Otherwise, each outer flap of the lower sheet may be folded upwardly and secured adhesively to the outer wall of a respective one of the outer stringers. In either case, each of the outer flaps of the lower sheet is folded upwardly at an obtuse angle relative to the planar portion of the lower sheet.

For added strength, each stringer may be optionally provided with apertures extending transversely through such stringer and may have a plurality of similar reinforcing members, each extending through a respective one of the apertures and being secured adhesively to such stringer.

In each embodiment comprising an additional stringer between the outer stringers, the additional stringer may have slots opening downwardly, and the paperboard pallet may further comprise means having slots opening upwardly for reinforcing the additional stringer. Thus, the additional stringer is engaged with the slots of the reinforcing means. Also, the reinforcing means is engaged with the slots of the additional stringer. It is contemplated, moreover, that such reinforcing means may be also used to reinforce the outer stringers.

Alternatively, this invention provides a paperboard pallet having a trapezoidal profile and comprising two rows of outer blocks in a rectangular array. Each outer flap is folded downwardly and secured in surface-to-surface contact to the outer walls of at least two of the outer blocks. Each outer block has a tapered profile, preferably a trapezoidal profile, which defines a broad end and a narrow end, whereupon the upper sheet is secured in surface-to-surface contact to the broad end. Further, the paperboard pallet may comprise a lower sheet having two outer flaps, each being folded upwardly and being secured in surface-to-surface contact to the outer walls of at least two of the blocks.

In each embodiment contemplated by this invention, the stringers or blocks and each sheet secured in surface-to-surface contact to the stringers or blocks are integrated into a strong pallet, which provides substantial resistance to crushing and substantial beam strength in a longitudinal direction. The outer flaps of the sheet or sheets, as secured in surface-to-surface contact, protect the outer stringers or outer blocks against being accidentally torn from the sheet or sheets if the blades of a fork lift are slammed against the pallet.

These and other objects, features, and advantages of this invention are evident from the following description of several embodiments of this invention with reference to the accompanying drawings.

DETAILED DESCRIPTION OF ILLUSTRATED EMBODIMENTS

Six paperboard pallets, each according to a different embodiment of this invention, are shown in FIGS. 1 through 6 respectively. Each of these pallets has a trapezoidal profile. Each of these pallets comprises two outer stringers having a tapered profile defining a broad end, an opposite end, and two lateral walls tapering toward each other from the broad end to the opposite end. Preferably, the tapered profile is a trapezoidal profile defining a broad end and a narrow end. A common feature of each of these pallets is that it also comprises at least one sheet having two outer flaps, each being folded and being secured in surface-to-surface contact to the outer wall of a respective one of the outer stringers.

Figure 1:
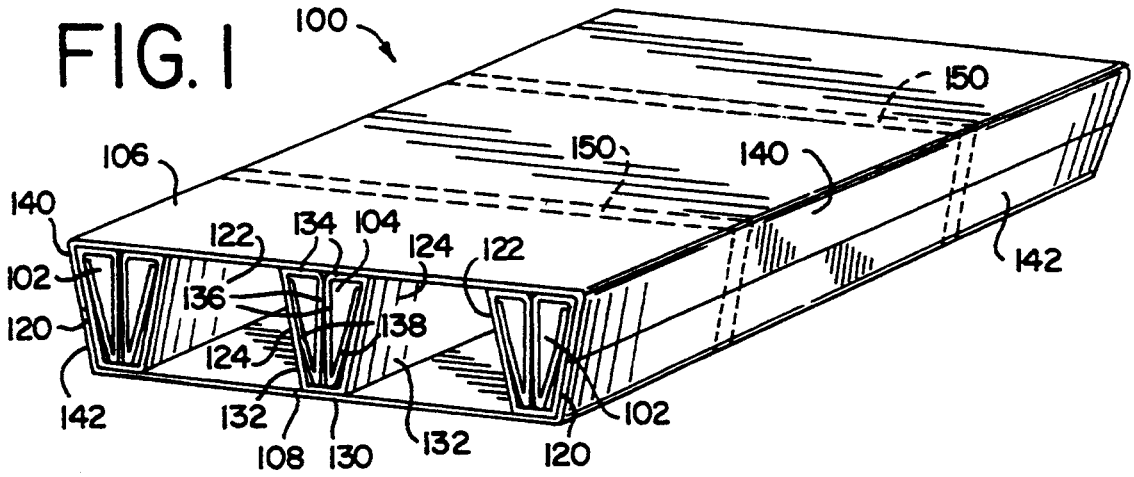
FIGS. 1 through 6 respectively are perspective views of six paperboard pallets, each according to a different embodiment of this invention. Portions are broken away in FIGS. 2, 3, and 4 to reveal features that would be otherwise hidden.

As shown in FIG. 1, a pallet 100 according to a first embodiment of this invention comprises three similar stringers extending longitudinally, namely two outer stringers 102 and one additional stringer 104 disposed between the outer stringers 102. Moreover, the pallet 100 comprises an upper sheet 106 secured in surface-to-surface contact and adhesively to the respective stringers 102, 104, and a lower sheet 108 secured similarly thereto. As shown, the pallet 100 has a trapezoidal profile.

Each stringer of the pallet 100 has a similar, trapezoidal profile defining a broad, upper end and a narrow, lower end. The broad, upper end defines a broad, generally planar surface, to and across which the upper sheet 106 is secured adhesively along such stringer, in surface-to-surface contact with such stringer. The broad, generally planar surface is interrupted approximately at a midline extending along such surface, where two panels described below come into close proximity. The narrow, lower end defines a narrow, generally planar surface, to and across which the lower sheet 108 is secured adhesively along such stringer, in surface-to-surface contact with such stringer.

Each outer stringer 102 has two lateral walls, namely an outer wall 120 and an inner wall 122, which taper toward each other from the broad, upper end of such outer stringer 102 to the narrow, lower end thereof. The additional stringer 104 has two lateral walls 124 tapering toward each other from the broad, upper end of the additional stringer 104 to the narrow, lower end thereof. Each lateral wall of each stringer of the pallet 100 defines an acute angle relative to the upper end of such stringer.

As exemplified by the additional stringer 104, each stringer of the pallet 100 is folded similarly from a single piece of paperboard material so as to have certain panels. Thus, such stringer has a lower panel 130 defining the narrow, lower end of such stringer. Also, such stringer has two lateral panels 132 extending upwardly and outwardly from the lower panel 130 and defining the lateral walls of such stringer. Further, such stringer has two upper panels 134 folded inwardly from the inner edges of the respective panels 132, coming into close proximity approximately at the broad, upper end of such stringer, and defining the broad, upper end of such stringer. Moreover, such stringer has two vertical panels 136 extending downwardly from the inner ends of the respective panels 134, approximately to the lower panel 130. Furthermore, such stringer has two inclined panels 138 extending upwardly and outwardly from the lower ends of the respective panels 136, against the respective panels 132, and approximately to the respective panels 134. The vertical panels 136 are secured adhesively to each other, at their interface, near the upper panels 134. The inclined panels 138 are secured adhesively to the respective panels 132, at the outside surfaces of the inclined panels 138 and the inside surfaces of the respective panels 132, near the respective panels 134.

Stringers similar to the stringer described in the preceding paragraph are used in standard-duty pallets available commercially from Gate Pallet Systems, Inc. of Crown Point, Ind., under its PAYLOAD trademark. Such standard-duty stringers have an upper width of approximately 3.25 inches, a lower width of approximately 1.5 inches, and a height of approximately 4 inches. If greater resistance to crushing and greater beam strength are desired, each stringer of the pallet 100 may conform to the stringers disclosed in Quasnick U.S. Pat. No. 4,867,074, the disclosure of which is incorporated herein by reference. Other stringers having tapered trapezoidal or triangular profiles may be alternatively used.

The upper and lower sheets 106, 108, are formed from paperboard material. The upper sheet 106 is folded so as to have a planar portion and two outer flaps 140. Each outer flap 140 is folded downwardly at an acute angle relative to the planar portion of the upper sheet 106 and is secured in surface-to-surface contact and adhesively to the outer surface of the outer wall 120 of a respective one of the outer stringers 102, across the inner surface of such outer flap 140, and along the stringer 102. The lower sheet 108 is folded so as to have a planar portion and two outer flaps 142. Each outer flap 142 is folded upwardly at an obtuse angle relative to the planar portion of the lower sheet 108 and is secured in surface-to-surface contact and adhesively to the outer surface of the outer wall 120 of a respective one of the outer stringers 102, across the inner surface of such outer flap 142, and along the stringer 102. The lower edges of the outer flaps 140 of the upper sheet 106 and the upper edges of the outer flaps 142 of the lower sheet 108 abut, as shown, or come into close proximity, approximately midway between the upper and lower ends of the outer stringers 102.

As shown in broken lines in FIG. 1, for greater strength, the pallet 100 may be externally reinforced with tensioned loops 150 of polymeric strapping, such as poly(ethylene terephthalate) or polypropylene strapping, or of steel strapping. Such loops 150 are applied, in a known manner, so as to extend transversely across the sheets 106, 108.

Figure 2:
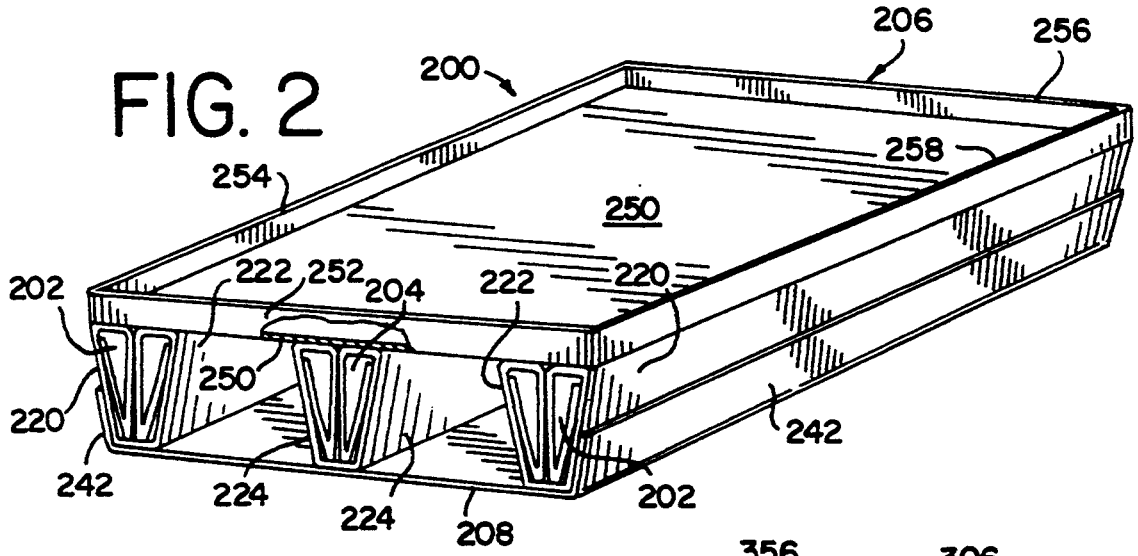

As shown in FIG. 2, a pallet 200 according to a second embodiment of this invention comprises three similar stringers extending longitudinally, namely two outer stringers 202 and one additional stringer 204 disposed between the outer stringers 202. Moreover, the pallet 200 is combined with a tray 206 secured adhesively to the respective stringers 202, 204, and comprises a lower sheet 208 secured adhesively thereto. As shown, the pallet 200 has a trapezoidal profile below the tray 206.

Each stringer of the pallet 200 is similar to each stringer of the pallet 100. Thus, each stringer of the pallet 200 has a tapered profile defining a broad, upper end and a narrow, lower end. Each outer stringer 202 has two lateral walls, namely an outer wall 220 and an inner wall 222, which taper toward each other from the broad, upper end of such outer stringer 202 to the narrow, lower end thereof. The additional stringer 204 has two lateral walls 224 tapering toward each other from the broad, upper end of the additional stringer 204 to the narrow, lower end thereof. Each lateral wall of each stringer of the pallet 200 defines an acute angle relative to the upper end of such stringer.

The tray 206, which has a known construction, may be also formed from paperboard material. The tray 206 has a base wall 250 secured in surface-to-surface contact and adhesively to, across, and along the broad, upper ends of the respective stringers 202, 204. The base wall 250 defines an upper sheet of the pallet 200 for purposes of this invention. The base wall 250 differs from the upper sheet 106 of the pallet 100 in not having any outer flaps. Also, the tray 206 has other walls 252, 254, 256, 258, which extend upwardly from the base wall 250. Further details of the tray 206 are outside the scope of this invention.

The lower sheet 208 is secured in surface-to-surface contact and adhesively to the narrow, lower ends of the respective stringers 202, 204. The lower sheet 208 is folded so as to have a planar portion and two outer flaps 242. Each outer flap 242 is folded upwardly at an obtuse angle relative to the planar portion of the lower sheet 208 and is secured adhesively to the outer surface of the outer wall 220 of a respective one of the outer stringers 202, across the inner surface of such outer flap 242, and along the stringer 202. As shown, the upper edges of the outer flaps 242 of the lower sheet 208 are disposed approximately midway between the upper and lower ends of the outer stringers 202. Alternatively, the upper edges of the outer flaps 242 may extend upwardly for a greater distance, possibly as far as the broad, upper ends of the outer stringers 202.

Figure 3:
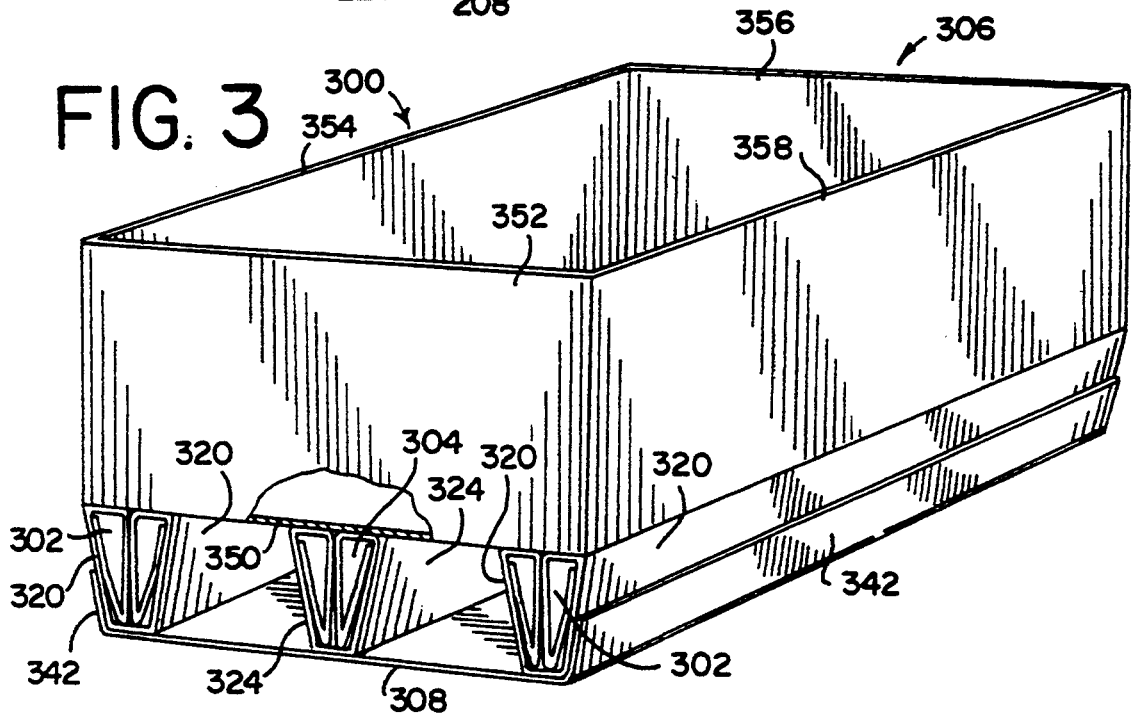

As shown in FIG. 3, a pallet 300 according to a third embodiment of this invention comprises three similar stringers extending longitudinally, namely two outer stringers 302 and one additional stringer 304 disposed between the outer stringers 302. Moreover, the pallet 300 is combined with a carton 306 secured adhesively to the respective stringers 302, 304, and comprises a lower sheet 308 secured adhesively thereto. As shown, the pallet 300 has trapezoidal profile, below the carton 306.

Each stringer of the pallet 300 is similar to each stringer of the pallet 100. Thus, each stringer of the pallet 300 has a tapered profile defining a broad, upper end and a narrow, lower end. Each outer stringer 302 has two lateral walls, namely an outer wall 320 and an inner wall 322, which taper toward each other from the broad, upper end of such outer stringer 302 to the narrow, lower end thereof. The additional stringer 304 has two lateral walls 324 tapering toward each other from the broad, upper end of the additional stringer 304 to the narrow, lower end thereof. Each lateral wall of each stringer of the pallet 300 defines an acute angle relative to the upper end of such stringer.

The carton 306, which has a known construction and which may be a so-called "regular slotted carton", may be also formed from paperboard material. The carton 306 has a base wall 350 secured adhesively to, across, and along the broad, upper ends of the respective stringers 302, 304. The base wall 350, which may comprise plural panels of the carton 306, defines an upper sheet of the pallet 300 for purposes of this invention. The base wall 350 differs from the upper sheet 106 of the pallet 100 in not having any outer flaps. Also, the carton 306 has other walls 352, 354, 356, 358, which extend upwardly from the base wall 350, and may have a cover (not shown) of a known construction. Further details of the carton 306 are outside the scope of this invention.

The lower sheet 308 is secured in surface-to-surface contact and adhesively to the narrow, lower ends of the respective stringers 302, 304. The lower sheet 308 is folded so as to have a planar portion and two outer flaps 342. Each outer flap 342 is folded upwardly at an obtuse angle relative to the planar portion of the lower sheet 308 and is secured adhesively to the outer surface of the outer wall 320 of a respective one of the outer stringers 302, across the inner surface of such outer flap 342, and along the stringer 302. As shown, the upper edges of the outer flaps 342 of the lower sheet 308 are disposed approximately midway between the upper and lower ends of the outer stringers 302. Alternatively, the upper edges of the outer flaps 342 may extend upwardly for a greater distance, possibly as far as the broad, upper ends of the outer stringer 302.

Figure 4:
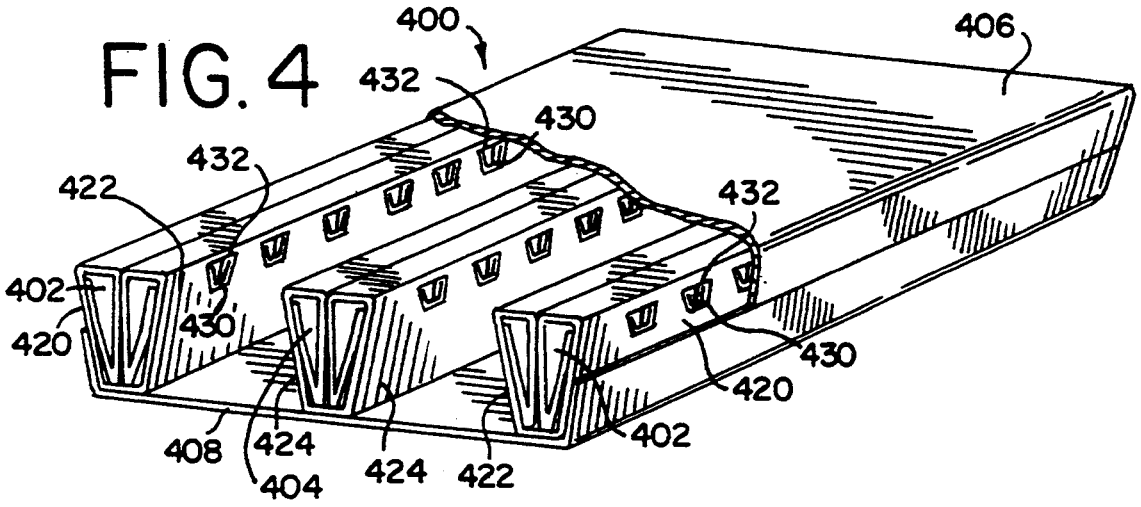

As shown in FIG. 4, a pallet 400 according to a fourth embodiment of this invention comprises three similar stringers extending longitudinally, namely two outer stringers 402 and one additional stringer 404 disposed between the outer stringers 402. Moreover, the pallet 400 comprises an upper sheet 406 secured in surface-to-surface contact and adhesively to the respective stringers 402, 404, and a lower sheet 408 secured similarly thereto.

Except as described below, each stringer of the pallet 400 is similar to each stringer of the pallet 100. Thus, each stringer of the pallet 400 has a tapered profile defining a broad, upper end and a narrow, lower end. Each outer stringer 402 has two lateral walls, namely an outer wall 420 and an inner wall 422, which taper toward each other from the broad, upper end of such outer stringer 402 to the narrow, lower end thereof. The additional stringer 404 has two lateral walls 424 tapering toward each other from the broad, upper end of the additional stringer 404 to the narrow, lower end thereof. Each lateral wall of each stringer of the pallet 400 defines an acute angle relative to the upper end of such stringer.

Each stringer of the pallet 400 has aligned apertures 430 extending through such stringer and defining a plurality of similar passages. For added strength, each stringer of the pallet 400 has a plurality of reinforcing members 432, each extending through a respective one of the passages and being secured adhesively to such stringer. As shown, the reinforcing members 432 extending through such passages defined in the outer stringers 402 are cut so as to be generally flush with the outer surfaces of the outer walls 420 of the outer stringers 402. Alternatively, the reinforcing members may be uncut decking members extending through aligned apertures in each stringer.

Preferably, the apertures 430 and the passages defined by the apertures 430 have similar, trapezoidal profiles, and the reinforcing members 432 have similar, trapezoidal profiles permitting the reinforcing members 432 to be snugly fitted within such passages. As mentioned above, the reinforcing members 432 are secured adhesively within such passages. Preferably, moreover, each reinforcing member 432 is cut from a decking member similar to the decking members disclosed in the Quasnick patent having its disclosure incorporated herein by reference and may be similarly secured. Other reinforcing members, such as tubular reinforcing members (not shown) fitting snugly within cylindrical passages (not shown) defined by cylindrical apertures, may be alternatively employed.

Each of the upper and lower sheets 406, 408, are similar to the upper and lower sheets 106, 108, of the pallet 100. The upper and lower sheets 406, 408, are secured in surface-to-surface contact and adhesively to the respective stringers 402, 404, as the upper and lower sheets 106, 108, are secured in surface-to-surface contact and adhesively to the respective stringers 102, 106, of the pallet 100.

Figure 5:
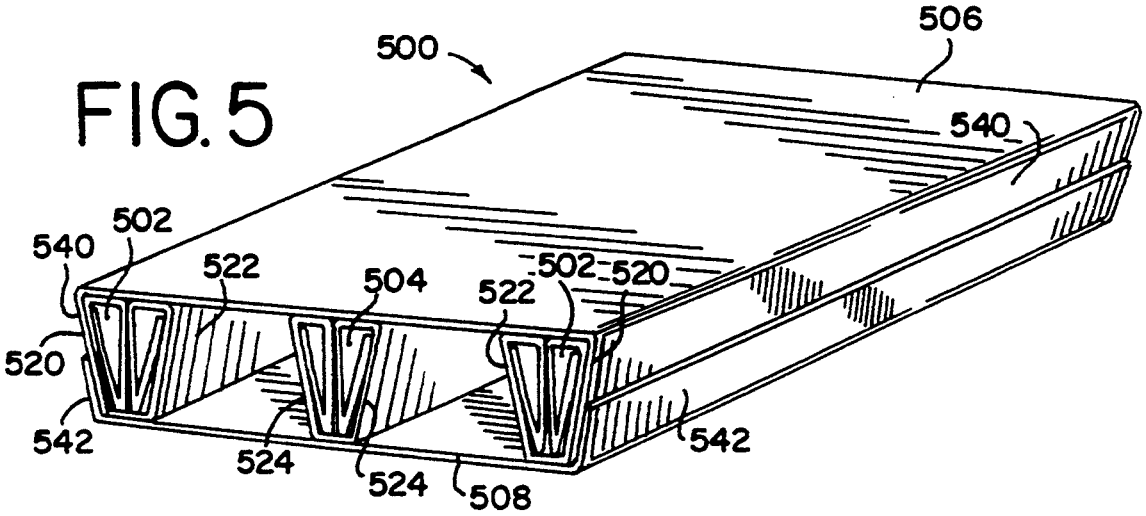

As shown in FIG. 5, a pallet 500 according to a fifth embodiment of this invention comprises three similar stringers extending longitudinally, namely two outer stringers 502 and one additional stringer 504 disposed between the outer stringers 502. Moreover, the pallet 500 comprises an upper sheet 506 secured in surface-to-surface contact and adhesively to the respective stringers 502, 504, and a lower sheet 508 secured similarly thereto.

Except as described below, each stringer of the pallet 500 is similar to each stringer of the pallet 100. Thus, each stringer of the pallet 500 has a tapered profile defining a broad, upper end and a narrow, lower end. Each outer stringer 502 has two lateral walls, namely an outer wall 520 and an inner wall 522, which taper toward each other from the broad, upper end of such outer stringer 502 to the narrow, lower end thereof. The additional stringer 504 has two lateral walls 524 tapering toward each other from the broad, upper end of the additional stringer 504 to the narrow, lower end thereof. Each lateral wall of each stringer of the pallet 500 defines an acute angle relative to the upper end of such stringer.

Each of the upper and lower sheets 506, 508, is made of paperboard material. The upper sheet 506 is secured in surface-to-surface contact and adhesively to the broad, upper ends of the respective stringers 502, 504. The upper sheet 506 is folded so as to have a planar portion and two outer flaps 540, which are folded downwardly at acute angles relative to planar portion of the upper sheet 506 and which differ from the outer flaps 140 of the upper sheet 106 of the pallet 100 in that each outer flap 540 extends further, so as to cover substantially all of the outer surfaces of the respective walls 520. Each outer flap 540 is secured in surface-to-surface contact and adhesively to the outer surface of the outer wall 520 of a respective one of the outer stringers 502, across the inner surface of such outer flap 540, and along the stringer 502. The lower sheet 508 is secured in surface-to-surface contact and adhesively to the narrow, lower ends of the respective stringers 502, 504. The lower sheet 508 is folded so as to have a planar portion and two outer flaps 542. Each outer flap 542 is folded upwardly at an obtuse angle relative to the planar portion of the lower sheet 508 and is secured in surface-to-surface contact and adhesively to the outer surface of a respective one of the outer flaps 540, across the inner surface of such outer flap 542, and along the stringer 502. As shown, the upper edges of the outer flaps 542 of the lower sheet 508 are disposed approximately midway between the upper and lower ends of the outer stringers 502. Alternatively, the upper edges of the outer flaps 542 may extend upwardly for a further distance, possibly as far as the broad, upper ends of the outer stringers 502.

Figure 6:
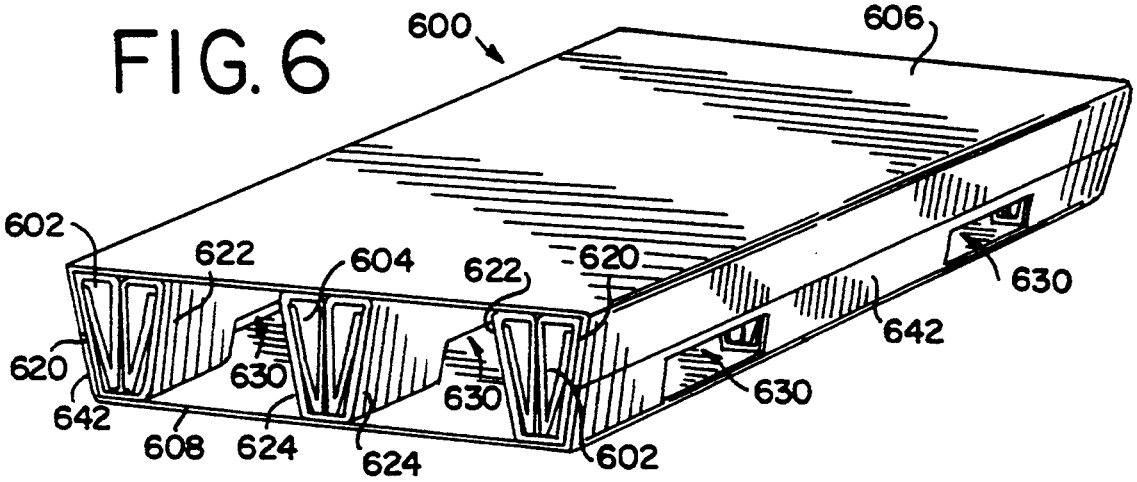

As shown in FIG. 6, a pallet 600 according to a sixth embodiment of this invention comprises three similar stringers extending longitudinally, namely two outer stringers 602 and one additional stringer 604 disposed between the outer stringers 602. Moreover, the pallet 600 comprises an upper sheet 606 secured in surface-to-surface contact and adhesively to the respective stringers 602, 604, and a lower sheet 608 secured similarly thereto. As shown, the pallet 600 has a trapezoidal profile.

Except as described below, each stringer of the pallet 600 is similar to each stringer of the pallet 100. Thus, each stringer of the pallet 600 has a tapered profile defining a broad, upper end and a narrow, lower end. Each outer stringer 602 has two lateral walls, namely an outer wall 620 and an inner wall 622, which taper toward each other from the broad, upper end of such outer stringer 602 to the narrow, lower end thereof. The additional stringer 604 has two lateral walls 624 tapering toward each other from the broad, upper end of the additional stringer 604 to the narrow, lower end thereof.

Except as described below, the upper and lower sheets 606, 608, are similar to the upper and lower sheets 106, 108, of the pallet. 100. The upper and lower sheets 606, 608, are secured in surface-to-surface contact and adhesively to the respective stringers 602, 604, as the upper and lower sheets 106, 108, are secured in surface-to-surface contact and adhesively to the respective stringers 102, 106, of the pallet 100.

The pallet 600, which is a so-called "four way" pallet, differs from the pallet 100, which is a so-called "two way" pallet, in that two rows of elongate slots 630 are provided to permit two blades of a fork lift (not shown) to enter the pallet 600 transversely from opposite directions. Also, the blades of the fork lift can enter the pallet 600 longitudinally from opposite directions. These slots 630 extend through each stringer of the pallet 600 and through the outer flaps 642 of the lower sheet 608. It is possible to provide similar slots (not shown) in any of the pallets 200, 300, 400, and 500.

Figure 7:
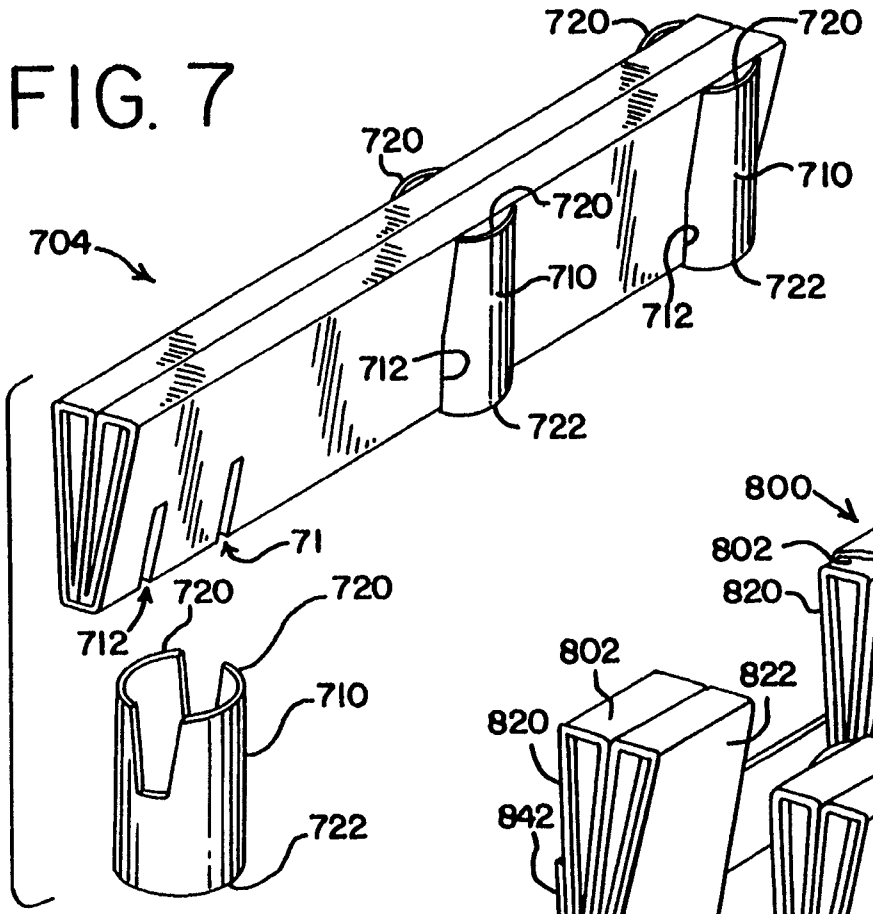
FIG. 7 is a perspective, partially exploded view of a modified stringer, which may be advantageously employed in certain of the illustrated pallets.

As shown in FIG. 7, a modified stringer 704 may be advantageously substituted for the additional stringer of any of the pallets 100, 200, 300, and 500. Three, similar, tubular reinforcing pieces 710 made from tightly wound paper tubing, such as that used for cores for paper rolls, are used to reinforce the modified stringer 704. The reinforcing pieces 710 are spaced uniformly along the modified stringer 704, one being disposed near each end of the modified stringer 704, and the other being disposed approximately midway between its ends.

The modified stringer 704 is similar to the additional stringers 104 of the pallet 100 except that the modified stringer 704 has two downwardly opening slots 712 for each reinforcing piece 710. Each reinforcing piece 710 has two upwardly opening slots 714. As shown, the modified stringer 704 is engaged within the slots 714 of each reinforcing piece 710 and each reinforcing piece 710 is engaged within two slots 712 of the modified stringer 704, preferably with a frictional fit in each instance.

Each reinforcing piece 710 has an annular, upper edge 720 (which is interrupted by the slots 714) and an annular, lower edge 722. The upper edges 720 are flush with the upper end of the modified stringer 704. The lower edge 722 is flush with the lower end of the modified stringer 704. The upper sheet of the pallet comprising the modified stringer 704 is secured adhesively to the upper end of the modified stringer 704 and to the upper edge 720 of each reinforcing piece 710. The lower sheet of such pallet is secured adhesively to the lower end of the modified stringer 704 and to the lower edge 722 of each reinforcing piece 710. The preferred adhesive noted above is preferred for securing the upper and lower sheets of such pallet to such edges thereto.

Although three reinforcing pieces are preferred, two may be alternatively used, near the ends of the stringer being reinforced. If shorter reinforcing pieces are used, such a modified stringer may be advantageously substituted for the additional stringer 404 of the pallet 400, except that the upper sheet 406 cannot be adhesively secured to the upper edges of such pieces. If it is provided with elongate slots similar to the slots 630, such a modified stringer may be advantageously substituted for the additional stringer 604 of the pallet 600.

If the outer flaps of the bottom sheet are provided with suitable cut-outs to accommodate the reinforcing pieces, such a modified stringer may be also substituted for each of the outer stringers. Alternatively, the outer flaps of the bottom sheet may extend between two such reinforcing pieces on each outer stringer, near opposite ends of such outer stringer.

Figure 8:
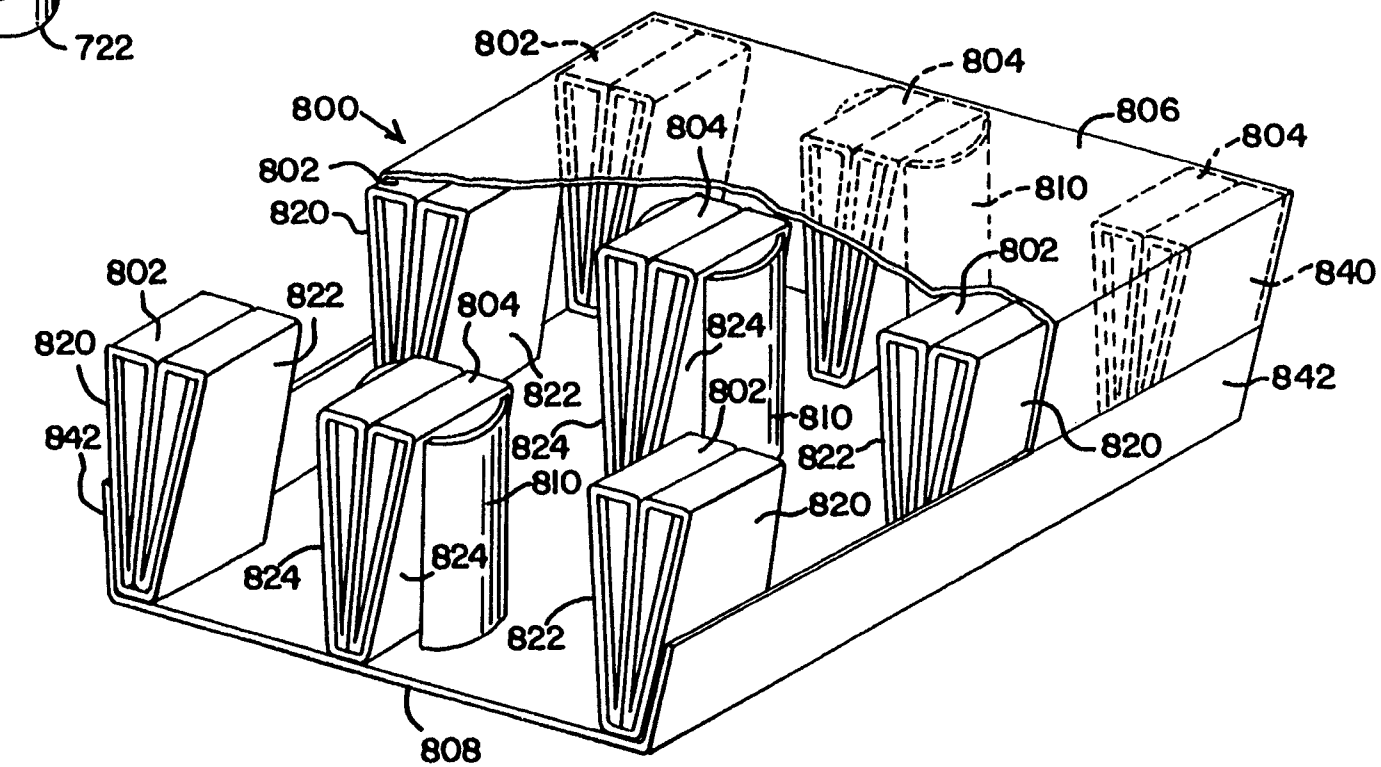
FIGS. 8 and 9 respectively are perspective views of two paperboard pallets, each according to a different embodiment of this invention. Portions are broken away in FIG. 8 to reveal features that would be otherwise hidden. Other features that would be otherwise hidden are shown in broken lines in FIGS. 8 and 9.

As shown in FIG. 8, a pallet 800 according to a different embodiment of this invention is an improved, so-called "nine block" pallet comprising two rows of outer blocks 802, a row of additional blocks 804 disposed between the outer blocks 802, an upper sheet 806 secured in surface-to-surface contact and adhesively to the respective blocks 802, 804, and a lower sheet 808 secured similarly thereto. The rows of blocks 802, 804, are spaced uniformly from one another and the blocks 802, 804, in each row are spaced uniformly from one another, so as to define a rectangular array of the blocks 802, 804. As shown, the pallet 800 has a trapezoidal profile.

Each outer block 802 is cut from a stringer similar to each stringer of the pallet 100. Thus, each outer block 802 has a tapered profile defining a broad, upper end and a narrow, lower end. Each outer block 802 has two lateral walls, namely an outer wall 820 and an inner wall 822, which taper toward each other from the broad, upper end of such outer stringer 804 to the narrow, lower end thereof.

Each additional block 804 is cut from a stringer similar to the stringer 704, so as to have a reinforcing piece 810 similar to one of the reinforcing pieces 710. Each additional block 804 has two lateral walls 824 tapering toward each other from the broad, upper end of such additional block to the narrow, lower end thereof.

The broad, upper end of each block defines a broad, generally planar surface, to and across which the upper sheet 806 is secured adhesively, along such block, in surface-to-surface contact with such block. The narrow, lower end of each block defines a narrow, generally planar surface, to and across which the lower sheet 808 is secured adhesively, in surface-to-surface contact with such block.

The upper and lower sheets 806, 808, are similar to the upper and lower sheets 106, 108, of the pallet 100. The upper sheet 806 is folded so as to have a planar portion and two outer flaps 840, each being folded downwardly at an acute angle relative to the planar portion of the upper sheet 806. Each outer flap 840 is secured in surface-to-surface contact and adhesively to the outer surfaces of the outer walls 820 of three outer blocks 802 in one of the two rows of outer blocks 802. One of the outer flaps 840 is hidden in FIG. 8. The lower sheet 808 is folded so as to have a planar portion and two outer flaps 842, each being folded upwardly at an obtuse angle relative to the planar portion of the lower sheet 808 and is secured in surface-to-surface contact and adhesively to the outer surfaces of the outer walls 820 of three outer blocks 802 in one of the two rows of outer blocks 802. The lower edges of the outer flaps 840 of the upper sheet 806 and the upper edges of the outer flaps 842 of the lower sheet 808 abut, as shown, or come into close proximity, approximately midway between the upper and lower ends of the outer blocks 802.

Figure 9:
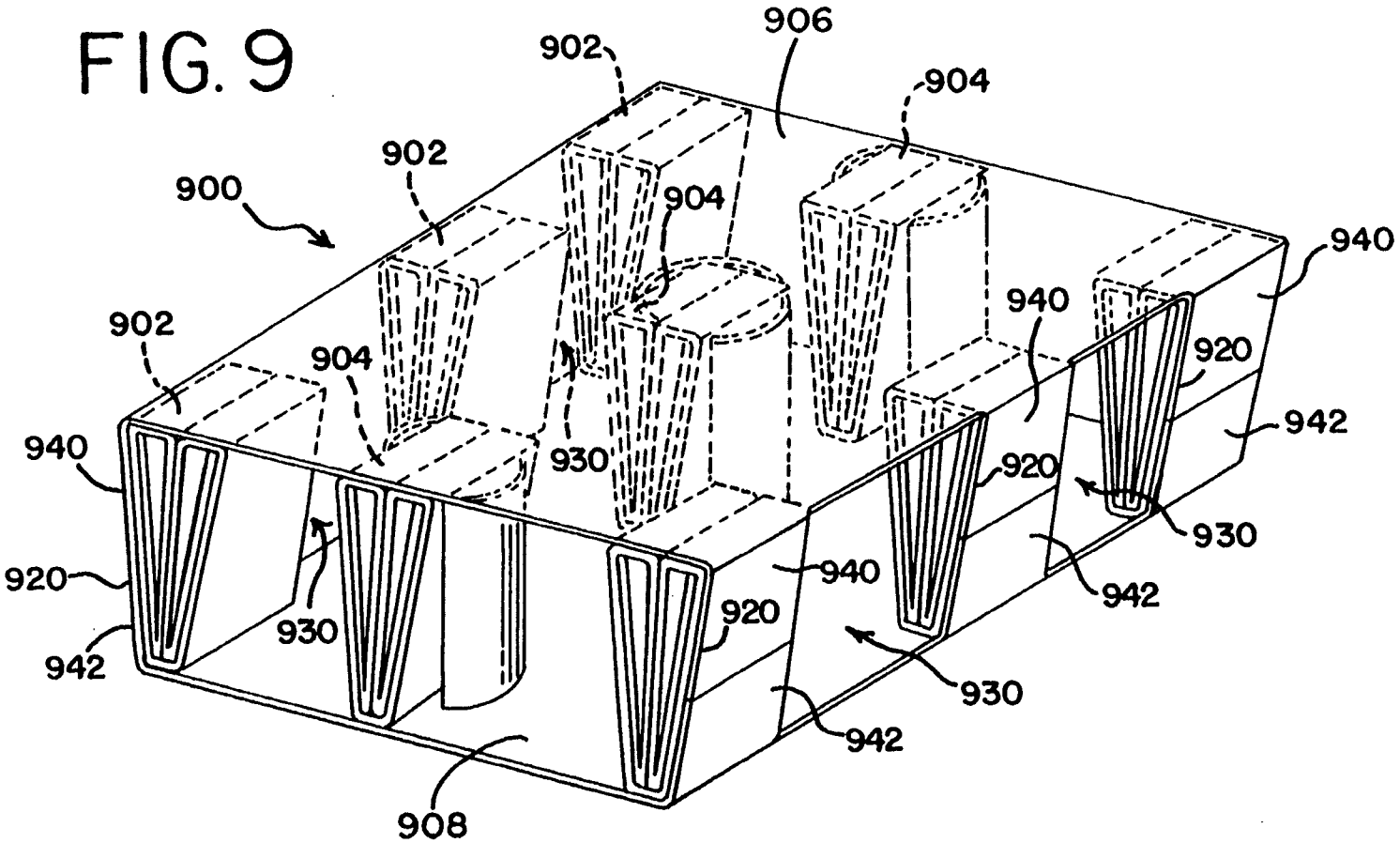

As shown in FIG. 9, a pallet 900 according to yet another embodiment of this invention is a modified form of the pallet 800 and comprises two rows of outer blocks 902, a row of additional blocks 904 disposed between the outer blocks 902, an upper sheet 906 secured in surface-to-surface contact and adhesively to the respective blocks 902, 904, and a lower sheet 908 secured similarly thereto. The outer blocks 902 are similar to the outer blocks 802 of the pallet 800. The additional blocks 904 are similar to the additional blocks 804 of the pallet 800. As shown, the pallet 900 has a trapezoidal profile.

Except as described below, the upper and lower sheets 906, 908, are similar to the upper and lower sheets 106, 108, of the pallet 100 and to the upper and lower sheets 806, 808, of the pallet 800. The upper and lower sheets 906, 908, are secured in surface-to-surface contact and adhesively to the respective blocks 902, 904, as the upper and lower sheets 806, 808, are secured in surface-to-surface contact and adhesively to the respective blocks 806, 808, of the pallet 800. The upper sheet 906 is folded so as to have two outer flaps 940, each being folded downwardly and secured in surface-to-surface contact and adhesively to the outer surfaces of the outer walls 920 of the outer blocks 902 in one of the two rows of outer blocks 902. The lower sheet 908 is folded so as to have two outer flaps 942, each being folded upwardly and secured in surface-to-surface contact and adhesively to the outer surfaces of the outer walls 920 of three outer blocks 902 in one of the two rows of outer blocks 902.

The pallet 900, which is a so-called "four way" pallet, differs from the pallet 800, which is a so-called "two way" pallet, in that the outer flaps 940 of the upper sheet 906 and the outer flaps 942 of the lower sheet 908 are cut away between upper and lower ends of the blocks 902, 904, and between the outer blocks 902 in each row of outer blocks 902, so as to define slots 930 permitting two blades of a fork lift (not shown) to enter the pallet 900 transversely from opposite directions. Also, the blades of the fork lift can enter the pallet 900 longitudinally from opposite directions.

Herein, all references to paperboard are intended to refer to corrugated paperboard, multi-ply paper, or similar material. A preferred material for the respective stringers or the respective blocks in each of the foregoing embodiments is double-wall, corrugated paperboard. A preferred material for the upper sheets in the embodiments shown in FIGS. 1, 4, 5, 6, 8, and 8 is double-wall, corrugated paperboard or triple-wall, corrugated paperboard. A preferred material for the bottom sheets in the embodiments shown in FIGS. 1, 4, 5, 6, 8 and 9 is single-wall, corrugated paperboard or double-wall, corrugated paperboard. In each instance, the paperboard may be tape-reinforced or fiber-reinforced, preferably in a transverse direction or in orthogonal directions. A preferred adhesive for securing the upper and lower sheets to the stringers and for securing the outer flaps, in each of the foregoing embodiments, is a so-called "cold melt" or "cold set" adhesive, such as Code No. 3715 or Code No. 3715B adhesive, both being available commercially from H. B. Fuller Co. of Palatine, Ill.

Although it is preferred to use an adhesive as means for securing such sheets to such ends and for securing such flaps, it is contemplated that staples, rivets, or other mechanical fasteners capable of maintaining surface-to-surface contact without slippage may be additionally or alternatively used.

Although each of the pallets 100, 400, 500, 600, 800, and 900 is shown in a preferred orientation, it should be here noted that these pallets would be also useful if inverted. Therefore, in regard to these pallets, directional terms used herein (such as "upper", "lower", "upwardly", and "downwardly") are used to refer to the preferred orientation and are not intended to limit this invention.

In each of the illustrated and described embodiments, the stringers or blocks and the upper and lower sheets secured in surface-to-surface contact to the stringers are integrated into a strong pallet, which provides substantial resistance to crushing and substantial beam strength in a longitudinal direction. The outer flaps of the sheets,.as secured in surface-to-surface contact, protect the outer stringers or outer blocks against being accidentally torn from the sheet or sheets if the blades of a fork lift are slammed against the pallet.

Various modifications may be made in the illustrated and described embodiments without departing from the scope and spirit of this invention.

We claim:

1. A paperboard pallet having a trapezoidal profile and comprising two outer stringers spaced laterally from each other, an upper sheet, and a lower sheet, each outer stringer having a tapered profile defining a broad, upper end, a lower end, and two lateral walls tapering toward each other from the broad, upper end to the lower end, the lateral walls including an outer wall defining an acute angle relative to the upper end, the upper sheet having a planar portion covering the upper ends of the outer stringers, the upper sheet being secured in surface-to-surface contact to the broad, upper end of each outer stringer, the lower sheet having a planar portion disposed beneath and covering the lower ends of the outer stringers, the lower sheet having two outer flaps, said planar portion of the upper sheet being wider in a lateral sense than said planar portion of the lower sheet, each outer flap of the lower sheet being folded upwardly at an obtuse angle relative to the planar portion of the lower sheet and being secured in surface-to-surface contact to the outer wall of a respective one of the outer stringers.

2. The paperboard pallet of claim 1 wherein each outer stringer has a trapezoidal profile defining a narrow, lower end, to which the lower sheet is secured in surface-to-surface contact.

3. The paperboard pallet of claim 1 further comprising at least one additional stringer disposed between the outer stringers, the upper and lower sheets being secured to such additional stringer.

4. The paperboard pallet of claim 3 wherein each of the outer and additional stringers has a trapezoidal profile defining a narrow, lower end, to which the lower sheet is secured in surface-to-surface contact.

5. The paperboard pallet of claim 4 wherein at least one said stringer has slots opening downwardly, and wherein said pallet further comprises means having slots opening upwardly for reinforcing said at least one stringer, said at least one stringer being engaged within the slots of the reinforcing means and the reinforcing means being engaged within the slots of said at least one stringer.

6. The paperboard pallet of claim 1 wherein each stringer has a plurality of apertures extending through such stringer and includes a plurality of similar reinforcing members, each extending through a respective one of the apertures and being secured adhesively to such stringer.

7. The paperboard pallet of claim 1 wherein the upper sheet has two outer flaps, each being folded downwardly at an acute angle relative to the planar portion of the upper sheet and being secured in surface-to-surface contact to the outer wall of a respective one of the outer stringers.

8. The paperboard pallet of claim 1 combined with a paperboard tray having a base wall defining the upper sheet of the paperboard pallet.

9. The paperboard pallet of claim 1 combined with a paperboard carton comprising a base wall defining the upper sheet of the paperboard pallet.

10. The paperboard pallet of claim 1 having elongate slots extending transversely through each stringer and through the outer flaps of the lower sheet.

11. A paperboard pallet having a trapezoidal profile and comprising two outer stringers spaced laterally from each other, an upper sheet, and a lower sheet, each outer stringer having a tapered profile defining a broad, upper end, a lower end, and two lateral walls including an outer wall defining an acute angle relative to the upper end, the upper sheet having a planar portion covering the upper ends of the outer stringers, the upper sheet having two outer flaps, each outer flap of the upper sheet being folded downwardly at an acute angle relative to the planar portion of the upper sheet and being secured in surface-to-surface contact and adhesively to the outer wall of a respective one of the outer stringers, the lower sheet having a planar portion disposed beneath the lower ends of the outer stringer, said planar portion of the upper sheet being broader in a lateral sense than said planar portion of the lower sheet, the planar portion of the lower sheet covering the lower ends of the outer stringers, the lower sheet being secured adhesively to the outer stringer.

12. The paperboard pallet of claim 11 wherein each outer flap of the upper sheet extends downwardly from the upper end of the respective one of the outer stringers to the lower end thereof.

13. The paperboard pallet of claim 12 further comprising a lower sheet having a planar portion and two outer flaps, each being folded upwardly at an obtuse angle relative to the planar portion of the lower sheet and being secured in surface-to-surface contact and adhesively to a respective one of the outer flaps of the upper sheet.

14. The paperboard pallet of claim 11 the two outer flaps, each being folded upwardly at an obtuse angle relative to the planar portion of the lower sheet and being secured in surface-to-surface contact and adhesively to the outer wall of a respective one of the outer stringers.

15. The paperboard pallet of claim 14 comprising at least one additional stringer disposed between the outer stringers, each additional stringer having a profile defining an upper end and a lower end, the upper sheet being secured adhesively to the upper end of each additional stringer, the lower sheet being secured adhesively to the lower end of each additional stringer.

16. A paperboard pallet having a trapezoidal profile and comprising two outer stringers spaced laterally from each other, an upper sheet, and a lower sheet, each outer stringer having a tapered profile defining a broad, upper end, a lower end, and two lateral walls tapering toward each other from the broad, upper end to the lower end, the lateral walls including an outer wall defining an acute angle relative to the upper end, the upper sheet having a planar portion covering the upper ends of the outer stringers, the upper sheet being secured in surface-to-surface contact to the broad, upper end of each outer stringer, the lower sheet being disposed beneath the lower ends of the outer stringers, the lower sheet having two laterally spaced folds defining two outer flaps, said planar portion of the upper sheet being broader in a lateral sense than the lateral spacing between said folds, each outer flap of the lower sheet being folded upwardly at an obtuse angle at a respective one of said folds and being secured to the outer wall of a respective one of the outer stringers.

17. The pallet of claim 16 wherein the lower sheet is secured to the outer surface in surface-to-surface contact between each outer flap and the outer wall of a respective one of the outer stringers.

* * * * *

UNITED STATES PATENT AND TRADEMARK OFFICE

CERTIFICATE OF CORRECTION

PATENT NO. : 5,372,074

DATED : December 13, 1994

INVENTOR(S) : Ted D. Kilpatrick and Arthur M. Wagner

It is certified that error appears in the above-indentified patent and that said Letters Patent is hereby corrected as shown below:

Col. 1, line 6, "the" should be deleted.

Col. 11, line 33, the second usage of "8" should be --9--.

Col. 13:
Claim 14, in the first line, after "the" and before "two", the words --lower sheet having-- should be inserted.

Signed and Sealed this

Eighteenth Day of April, 1995

Bruce Lehman

*Attest:*

BRUCE LEHMAN

*Commissioner of Patents and Trademarks*

*Attesting Officer*